United States Patent [19]

Henry

[11] 4,211,974

[45] Jul. 8, 1980

[54] METHOD FOR ORIENTING A BOREHOLE CORE

[75] Inventor: William E. Henry, Bartlesville, Okla.

[73] Assignee: Phillips Petroleum Company, Bartlesville, Okla.

[21] Appl. No.: 942,012

[22] Filed: Sep. 13, 1978

[51] Int. Cl.[2] ..... G01V 3/08

[52] U.S. Cl. ..... 324/377

[58] Field of Search ..... 324/14; 175/44

[56] References Cited

U.S. PATENT DOCUMENTS

| | | | |
|---|---|---|---|
| 2,104,743 | 1/1938 | Herrick | 324/14 X |
| 2,292,838 | 8/1942 | Jones . | |
| 2,500,680 | 3/1950 | Herrick et al. . | |
| 2,634,317 | 4/1953 | Marchand et al. | 324/14 |
| 2,652,531 | 9/1953 | Schaufelberger et al. . | |
| 2,820,610 | 1/1958 | Martinez . | |
| 3,088,528 | 5/1963 | Patton et al. . | |
| 3,393,359 | 7/1968 | Winkel | 324/14 |

OTHER PUBLICATIONS

Fuller, M., Magnetic Orientation of Borehole Cores, *Geophysics,* vol. 34, No. 5 (Oct. 1969), pp. 772–774.

Zijderveld, J.D.A., *A.C. Demagnetization of Rocks:Analysis of Results,* Methods in Paleomagnetism, edited by Collinsen, Creer & Runcord, Elsevier, pp. 254–286, 1967.

*Primary Examiner*—Gerard R. Strecker

[57] ABSTRACT

In the drilling of deep holes in the earth for exploration for minerals and petroleum, borehole cores are often obtained for examination by geologists. The drill string of the drilling rig used in the drilling operation will usually impart a strong remanent magnetism to the borehole core. The remanent magnetism is oriented substantially parallel to the longitudinal axis of the drill string. A method is provided whereby the borehole core or a portion thereof may be correctly oriented with respect to the longitudinal axis of the drill string by sequentially demagnetizing the core, recording magnetization intensity, and plotting the magnetization intensity and direction to show the direction of the remanent magnetism being removed. The direction of the remanent magnetism provides a basis for correctly orienting the borehole core.

5 Claims, 6 Drawing Figures

Figure 1:
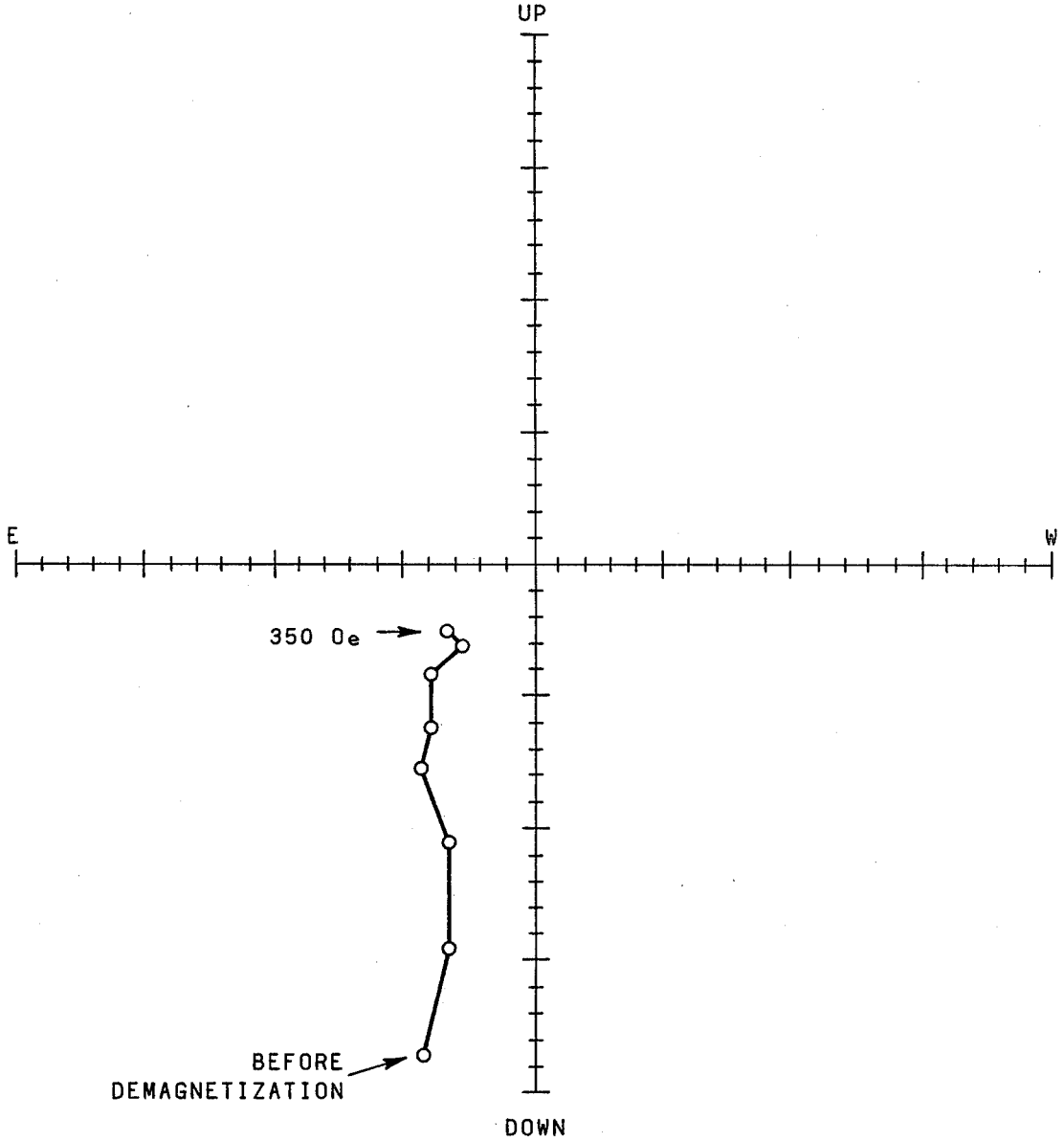

AKERS B-1, 6880.0 FT.
UNIT EQUALS 0.16

AKERS B-1, 6880.0 FT.
UNIT EQUALS 0.16

AKERS B-1, 6880.1 FT.
UNIT EQUALS 0.16

AKERS B-1,6882.0 FT.
UNIT EQUALS 0.40

AKERS B-1,6882.1 FT.
UNIT EQUALS 0.20

AKERS B-1,6882.2 FT.
UNIT EQUALS 0.16

AKERS B-1, 6888.0 FT.
UNIT EQUALS 0.16

METHOD FOR ORIENTING A BOREHOLE CORE

This invention relates to a method for correctly orienting a borehole core or sample so that its original longitudinal attitude within the earth may be known.

During the drilling of a borehole in the search for oil or other minerals, core samples are cut from the formations being traversed and are removed to the earth's surface for examination by geologists. Various important information can be obtained from such a core. For example, if any bedding planes are observable in the core, the strike and dip of these planes (and hence of the formation from which the core was obtained) can be determined. The true directions of strike and dip, however, can be determined only if the core can be oriented in the same way that it was oriented in its original place in the formation from which the core was taken. Other information, which can be obtained from a borehole core only if the correct orientation of the borehole core in the formation from which it is taken is known, includes the directional trends of the rock formation or the directional trends of the permeability of the rock formation.

Various methods have been proposed to determine the orientation of borehole cores. In one method of core orientation, a physical mark or scratch of known orientation is first applied to the formation at the bottom of the borehole, which is the formation to be cored. After the core is subsequently drilled and removed to the earth's surface it can be oriented by reference to this mark. However, often the core breaks into many pieces while being drilled and removed, and it is then possible to orient only the topmost portion of the core, that is, the portion which possesses the orienting mark. The other pieces of the core cannot be oriented. Also mechanical methods which involve marking of the borehole core are usually time consuming.

Because of these disadvantages in mechanical methods for orienting borehole cores, magnetic methods are generally favored over mechanical methods. One magnetic method which has been utilized in the past involves the determination of the direction of the natural magnetism of the borehole core. However, determination of the direction of the natural magnetism of the borehole core is difficult to achieve with accuracy because of the weakness of the natural magnetism. Also, the direction of the natural magnetism of the earth formation has been reversed in the geologic past and it is difficult to determine what the correct direction of the natural magnetism should be.

In another method of magnetic core orientation, a plug of ferro-magnetic material or particles of a magnetic material are inserted into the top of the core. The ferro-magnetic material is then magnetized by the earth's magnetic field and hence serves in the subsequent orientation of the core. However, complete orientation of all sections of the core is not possible if the core is broken during its drilling or removal. Also this procedure is very time consuming.

Another magnetic method for orienting a borehole core involves imposing a magnetic field by artificial means on the borehole core. This method is effective but has the disadvantages of increasing the cost and complexity of the required equipment. Large battery supplies and equipment for inducing a magnetic field in a borehole core while the core is still in the formation is required. Also the coring tool must be stopped during imposition of the magnetic fields which results in a more time consuming procedure.

It is thus an object of this invention to provide a method for determination of the orientation of a borehole core or sample relative to the longitudinal axis of the drill string so that its original position within the earth may be known. This method avoids the problems of the prior art noted in the preceding paragraphs and also improves the accuracy of the borehole core orientation while decreasing the time consumed in both taking the borehole core and orienting the borehole core.

The term "top" herein is used to identify the end of the core or sample nearest the drill rig and the term "bottom" means the end furthest away from the drill rig. Also, when it is stated that the borehole core is oriented with respect to the longitudinal axis of the drill string it is meant that the borehole core is oriented with respect to the longitudinal axis of the portion of the drill string which cut the borehole core.

A brief review of the present theories concerning the magnetic composition of rock formations is helpful in understanding the present invention. It is well known that as the rock formations cool a natural remanent magnetism is imparted to the rock formation by the earth's magnetic field. This natural remanent magnetism does not change after the rock formation has cooled. The natural remanent magnetism is considered a "hard" magnetism, meaning that it is very stable and difficult to remove by demagnetization.

A second type of magnetism that may occur in a rock formation will be referred to as an artificial remanent magnetism. This magnetism is not imparted by nature but is rather imparted by artificial means. The artificial remanent magnetism is generally "softer" than the natural remanent magnetism in that the artificial remanent magnetism is not as stable as the natural remanent magnetism and is easier to remove by demagnetization than the natural remanent magnetism.

As has been previously stated, several attempts have been made in the past to use the natural remanent magnetism to correctly orient the borehole core. However, the weakness of the natural remanent magnetism and uncertainties concerning the correct orientation of the natural remanent magnetism have caused difficulties in this procedure. Attempts have also been made to induce an artificial remanent magnetism into the core while the core is still in the earth formation. Problems associated with this procedure have already been noted.

In the present invention, it has been found that the drill string of a drilling rig will usually impart a magnetic component, which is oriented substantially parallel to the longitudinal axis of the drill string, to the borehole core. The vertically inclined magnetic component imparted by the drill string points down towards the bottom of the borehole core in the Northern hemisphere and up towards the top of the borehole core in the Southern hemisphere. The magnetic component imparted by the drill string is "softer" than the natural remanent magnetism.

In the present invention a method is provided whereby this magnetic component imparted by the drill string is isolated by partial demagnetization and the direction of the vertical component is determined. In this manner the borehole core may be correctly oriented, even though the core may have broken into parts, without the use of additional equipment to induce an artificial remanent magnetism into the borehole core.

Apparently the artificial remanent magnetism induced in the borehole core by the drill string of the drill rig has been overlooked in the past. The method of the present invention uses this previously overlooked, vertically inclined, artificial remanent magnetism imparted by the drill string to provide a very accurate and fast determination of the correct orientation of the borehole core or portion thereof, thus eliminating many of the problems, which have been set forth, that were associated with past methods of orienting a borehole core. The method of the present invention is also applicable when the borehole core has broken into parts, thus again solving a problem which was inherent in some mechanical and magnetic methods for orienting a borehole core.

Other objects and advantages of the invention will be apparent from the following detailed description of the method of the invention and the appended claims.

FIGS. 1–6 are graphical representations of the direction and intensity of the magnetism of core specimens as the specimens are progressively demagnetized.

In the present invention a borehole core is obtained by a conventional method during the drilling of a borehole in the search for oil or other minerals. This borehole core is brought to the surface where it may be easily studied. To orient the borehole core in accordance with the present invention a specimen of the core is first drilled. Preferably this specimen is a one inch cylinder of the borehole core which is a size compatible with modern equipment for demagnetizing and measuring magnetic field strength. Once a desired specimen has been obtained the core specimen is partially demagnetized in steps. After each demagnetization step a magnetometer is used to measure the remaining magnetization of the core specimen.

There are many commercial instruments available for demagnetizing a core specimen. Preferably the GSD-1 AC Geophysical Specimen Demagnetizer manufactured by Schonstedt Instrument Company, Reston, Virginia is utilized in the present invention. The operation of the GSD-1 AC Geophysical Specimen Demagnetizer is well documented as is set forth in the instruction manual prepared by the Schonstedt Instrument Company dated December, 1974. Briefly, the GSD-1 is a single axis, AC demagnetizer useful for the analysis of remanent magnetization of geological specimens such as a core sample. The primary function of the instrument is to remove from such core specimens any soft, unstable magnetization such as an artificial remanent magnetization that may have been acquired, while not significantly affecting the more stable natural remanent magnetization. Because the artificial remanent magnetism imparted by the drill string of the drill rig is softer than the natural remanent magnetism, the GSD-1 Demagnetizer functions to remove the artificial remanent magnetism by partial demagnetization in steps. The natural remanent magnetism is not removed by the GSD-1 demagnetizer and thus does not interfere with the measurements of the artificial remanent magnetism that are used to determine the direction of the artificial remanent magnetism in order to correctly orient the borehole core.

There are also many commercial magnetometers available which could be utilized to measure the magnetism in the core specimen. In the present invention a magnetometer and computer system manufactured by Digico Limited, Stevenage Hertfordshire, England is preferably used to measure the magnetism of the core specimen. The operation of the magnetometer and computer system manufactured by Digico is well documented and is set forth completely in specification DA-7214-0-16 which is provided by Digico Limited. The magnetometer and computer manufactured by Digico Limited provides a computer printout of the "X", "Y" and "Z" components of the magnetization vector for the core sample 1 after partial demagnetization. For the Digico magnetometer system "X" is the magnetization intensity in the North direction, "Y" is the magnetization intensity in the East direction and "Z" is the magnetization intensity in the vertical down direction.

Because the artificial remanent magnetism imparted by the drill string of the drill rig is oriented substantially parallel to the longitudinal axis of the drill string or "vertically", the "Y" and "Z" components of the magnetization vector are utilized to orient the borehole core. A plot of the "Z" component of the magnetization vector versus the "Y" component of the magnetization vector gives a quick indication of the correct orientation of the borehole core. The artificial remanent magnetization component should point down towards the bottom of the borehole core in plots of "Z" versus "Y" for cores taken in the Northern hemisphere and up towards the top of the borehole core for cores taken in the Southern hemisphere. If the reverse is found for a given borehole core, then the borehole core must be upside down.

The following examples are presented in further illustration of the invention. In all the examples the borehole core was taken from the Horizon-Cleveland Field, Ochiltree County, Tex. These cores are designated as AKERS B-1 followed by the depth at which the core sample was taken. The drill string was oriented substantially perpendicular to the earth's surface in the examples. All of the borehole cores were progressively demagnetized in 50 oersted ($O_e$) steps. The "X", "Y" and "Z" components of the magnetization vector are printed out in ($EMU/CM^3$)($10^{-6}$).

The computer printout set forth in the examples is provided by the Digico Magnetometer and computer system. The "X", "Y" and "Z" components have been corrected to orient the borehole core sample with respect to the borehole core from which the sample was taken.

EXAMPLE I

Table I presents the data for the borehole core sample taken at 6880.0 feet.

TABLE I

| | AKERS B-1,6880.0 Ft. | | |
|---|---|---|---|
| DEMAG(OE) | X | Y | Z |
| 0.0 | −6.691E−01 | 6.715E−01 | 2.970E+00 |
| 5.000E+ | −7.062E−01 | 5.074E−01 | 2.326E+00 |
| 1.000E+02 | −6.928E−01 | 5.070E−01 | 1.685E+00 |
| 1.500E+02 | −5.355E−01 | 6.879E−01 | 1.240E+00 |
| 2.000E+02 | −5.876E−01 | 6.257E−01 | 9.909E−01 |
| 2.500E+02 | −5.907E−01 | 6.247E−01 | 6.717E−01 |
| 3.000E+02 | −5.626E−01 | 4.427E−01 | 5.013E−01 |
| 3.500E+02 | −4.899E−01 | 5.421E−01 | 4.000E−01 |

FIG. 1 presents a plot of "Z" versus "Y", for the data of Table I, where "Y" increases positively in the East direction and "Z" increases positively in the down direction.

EXAMPLE II

Table II presents the data for the borehole core sample taken at 6880.1 ft.

TABLE II

| DEMAG(OE) | AKERS B-1,6880.1 Ft. X | Y | Z |
|---|---|---|---|
| 0.0 | −6.335E−01 | 9.217E−01 | 3.141E+00 |
| 5.000E+01 | −6.357E−01 | 5.111E−01 | 2.452E+00 |
| 1.000E+02 | −6.507E−01 | 7.101E−01 | 2.047E+00 |
| 1.500E+02 | −6.841E−01 | 5.905E−01 | 1.360E+00 |
| 2.000E+02 | −5.906E−01 | 5.764E−01 | 9.295E−01 |
| 2.500E+02 | −5.568E−01 | 6.077E−01 | 8.416E−01 |
| 3.000E+02 | −4.506E−01 | 4.115E−01 | 6.060E−01 |
| 3.500E+02 | −2.859E−01 | 5.810E−01 | 4.933E−01 |

Figure 2:
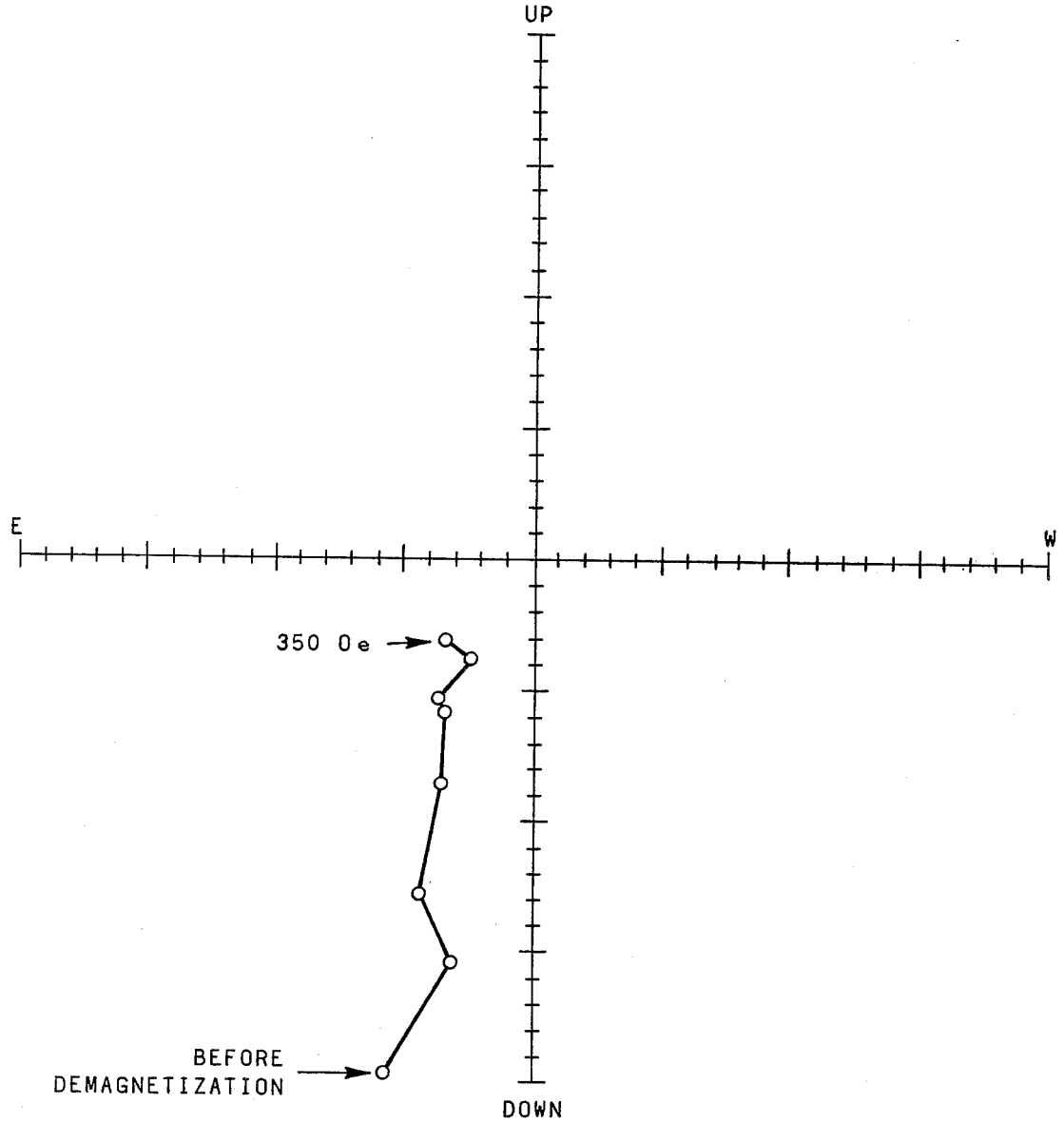

FIG. 2 presents a plot of "Z" versus "Y", for the data of Table II, where "Y" increases positively in the East direction and "Z" increases positively in the down direction.

EXAMPLE III

Table III presents the data for the borehole core sample taken at 6882.0 ft.

TABLE III

| DEMAG(OE) | AKERS B-1,6882.0 Ft. X | Y | Z |
|---|---|---|---|
| 0.0 | −1.274E+00 | −5.886E−01 | −4.894E+00 |
| 5.000E+01 | −9.670E−01 | −3.330E−01 | −3.244E+00 |
| 1.000E+02 | −7.434E−01 | −1.812E−01 | −1.735E+00 |
| 1.500E+02 | −6.345E−01 | −7.903E−02 | −1.192E+00 |
| 2.000E+02 | −5.242E−01 | −5.880E−02 | −9.675E−01 |
| 2.500E+02 | −5.447E−01 | −1.141E−02 | −7.126E−01 |
| 3.000E+02 | −4.581E−01 | 3.766E−02 | −5.516E−01 |
| 3.500E+02 | −3.573E−01 | 8.381E−02 | −4.960E−01 |

Figure 3:
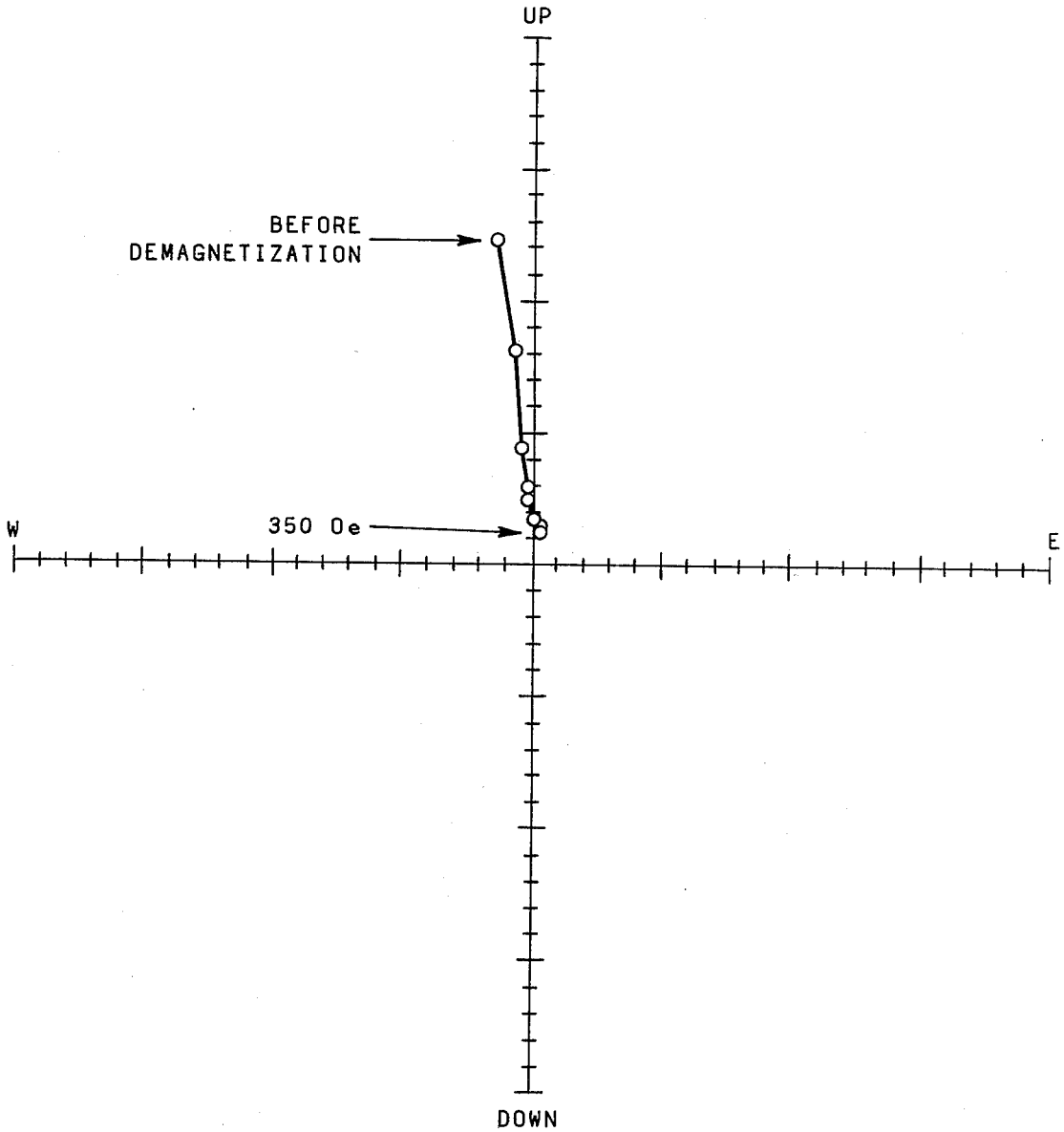

FIG. 3 presents a plot of "Z" versus "Y", for the data of Table III, where "Y" increases positively in the East direction and "Z" increases positively in the down direction.

EXAMPLE IV

Table IV presents the data for the borehole core sample taken at 6882.1 ft.

TABLE IV

| DEMAG(OE) | AKERS B-1,6882.1 Ft. X | Y | Z |
|---|---|---|---|
| 0.0 | −9.181E−01 | −6.357E−01 | −3.499E+00 |
| 5.000E+01 | −7.344E−01 | −3.921E−01 | −2.287E+00 |
| 1.000E+02 | −6.073E−01 | −2.404E−01 | −1.433E+00 |
| 1.500E+02 | −5.558E−01 | −1.594E−01 | −9.510E−01 |
| 2.000E+02 | −4.887E−01 | −1.401E−01 | −6.998E−01 |
| 2.500E+02 | −4.397E−01 | −1.319E−01 | −4.975E−01 |
| 3.000E+02 | −3.104E−01 | −1.521E−01 | −3.258E−01 |
| 3.500E+02 | −4.301E−01 | −4.900E−02 | −4.467E−01 |

Figure 4:
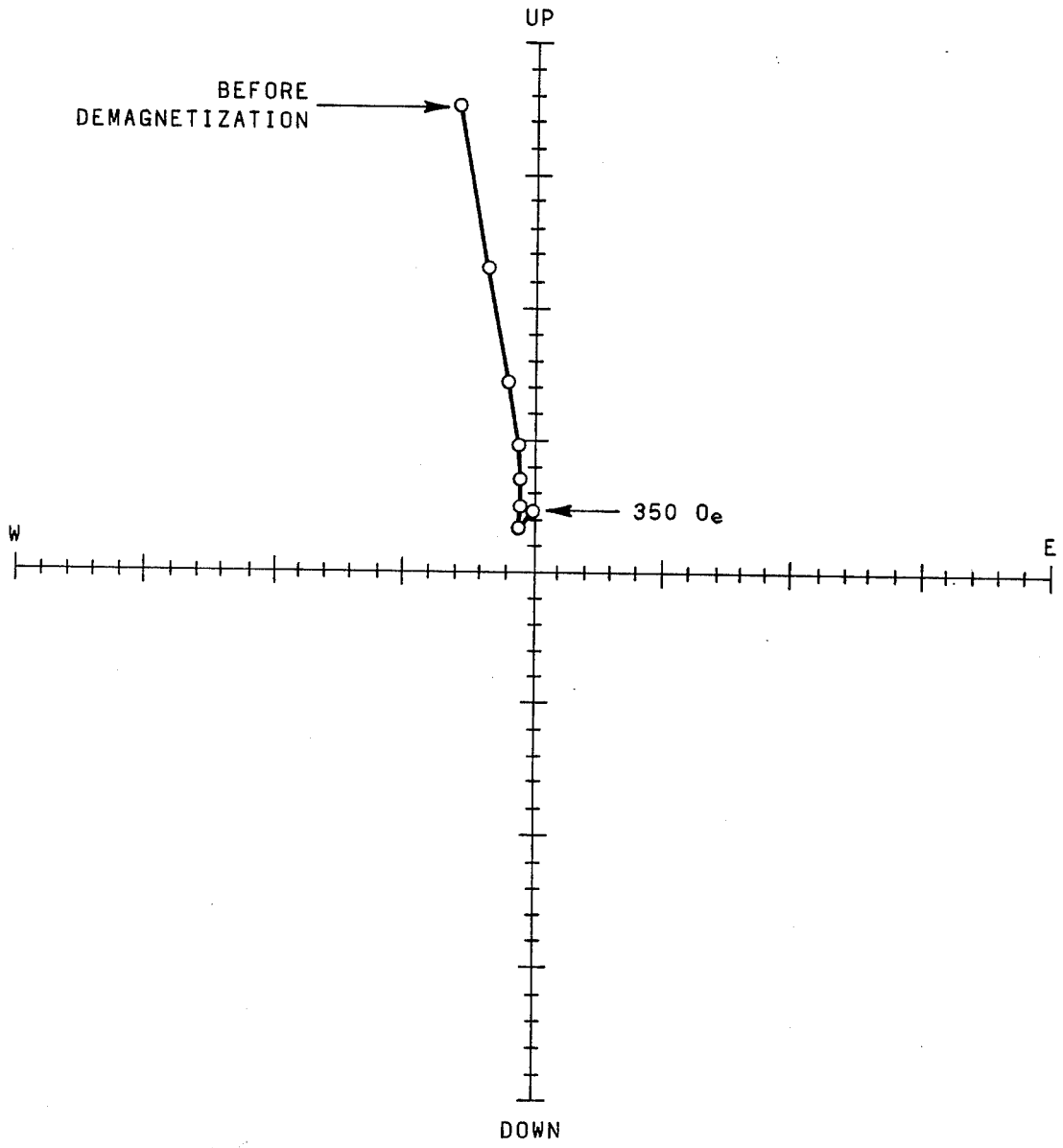

FIG. 4 presents a plot of "Z" versus "Y", for the data of Table IV, where "Y" increases positively in the East direction and "Z" increases positively in the down direction.

EXAMPLE V

Table V presents the data for the borehole core sample taken at 6882.2 ft.

TABLE V

| DEMAG(OE) | AKERS B-1,6882.2 Ft. X | Y | Z |
|---|---|---|---|
| 0.0 | −8.015E−01 | −1.098E−01 | −2.663E+00 |
| 5.000E+01 | −7.265E−01 | −1.268E−01 | −1.962E+00 |
| 1.000E+02 | −5.969E−01 | −9.240E−02 | −1.402E+00 |
| 1.500E+02 | −5.899E−01 | −4.643E−02 | −9.966E−01 |
| 2.000E+02 | −5.518E−01 | −4.343E−02 | −7.535E−01 |
| 2.500E+02 | −5.207E−01 | −6.362E−03 | −6.642E−01 |
| 3.000E+02 | −4.935E−01 | 3.445E−03 | −4.634E−01 |
| 3.500E+02 | −4.848E−01 | −4.241E−02 | −4.141E−01 |

Figure 5:
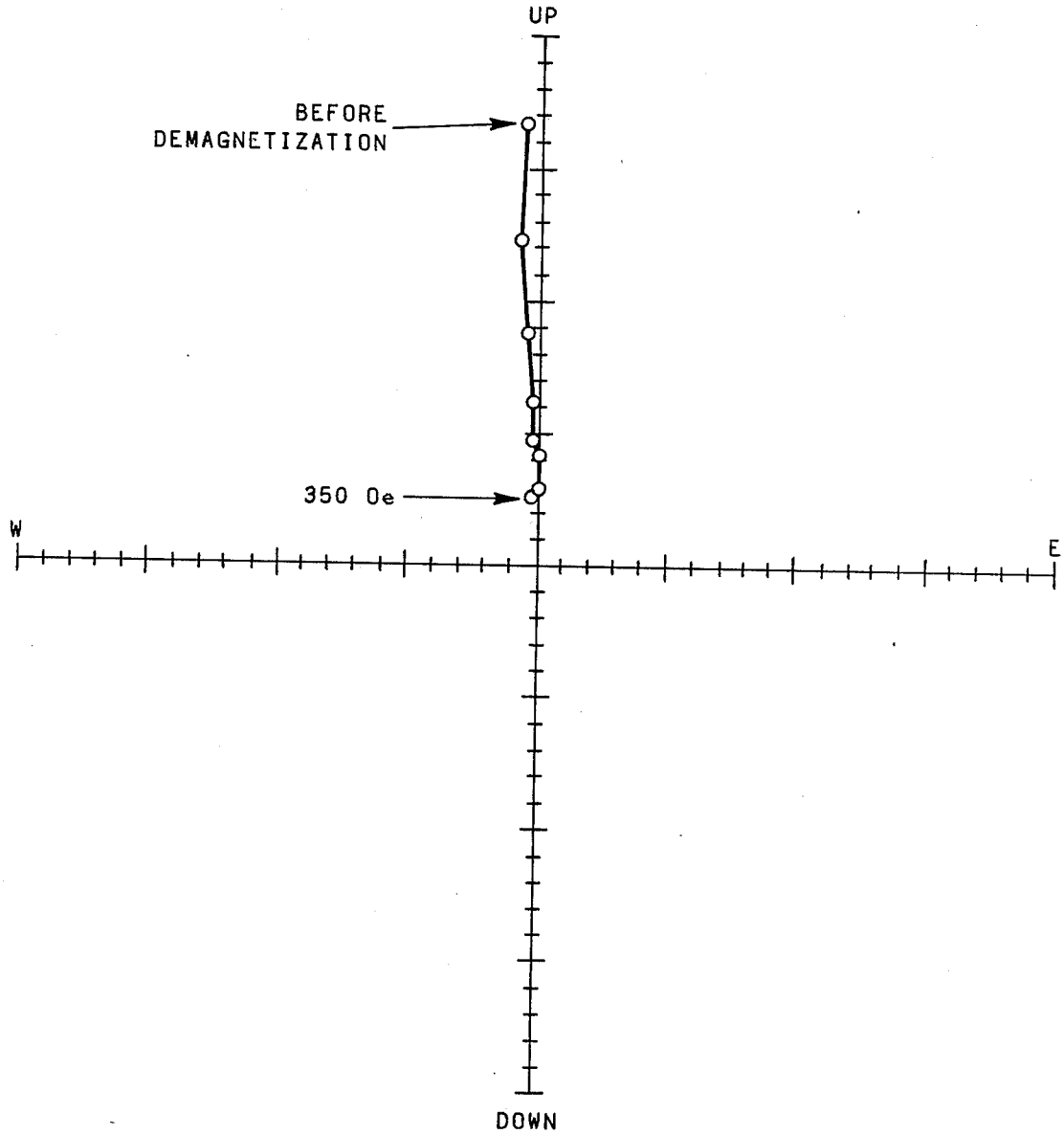

FIG. 5 presents a plot of "Z" versus "Y", for the data of Table V, where "Y" increases positively in the East direction and "Z" increases positively in the down direction.

EXAMPLE VI

Table VI presents the data for the borehole core sample taken at 6880.0 ft.

TABLE IV

| DEMAG(OE) | AKERS B-1,6888.0 Ft. X | Y | Z |
|---|---|---|---|
| 0.0 | −4.440E−01 | 4.041E−02 | 2.847E+00 |
| 5.000E+01 | −3.350E−01 | 1.273E−01 | 2.097E+00 |
| 1.000E+02 | −3.676E−01 | 1.553E−01 | 1.489E+00 |
| 1.500E+02 | −3.308E−01 | 1.343E−01 | 1.014E+00 |
| 2.000E+02 | −2.686E−01 | 8.365E−02 | 1.172E+00 |
| 2.500E+02 | −2.761E−01 | 2.244E−01 | 6.636E−01 |
| 3.000E+02 | −1.453E−01 | 2.146E−01 | 5.021E−01 |
| 3.500E+02 | −3.670E−01 | −3.843E−03 | 5.629E−01 |

Figure 6:
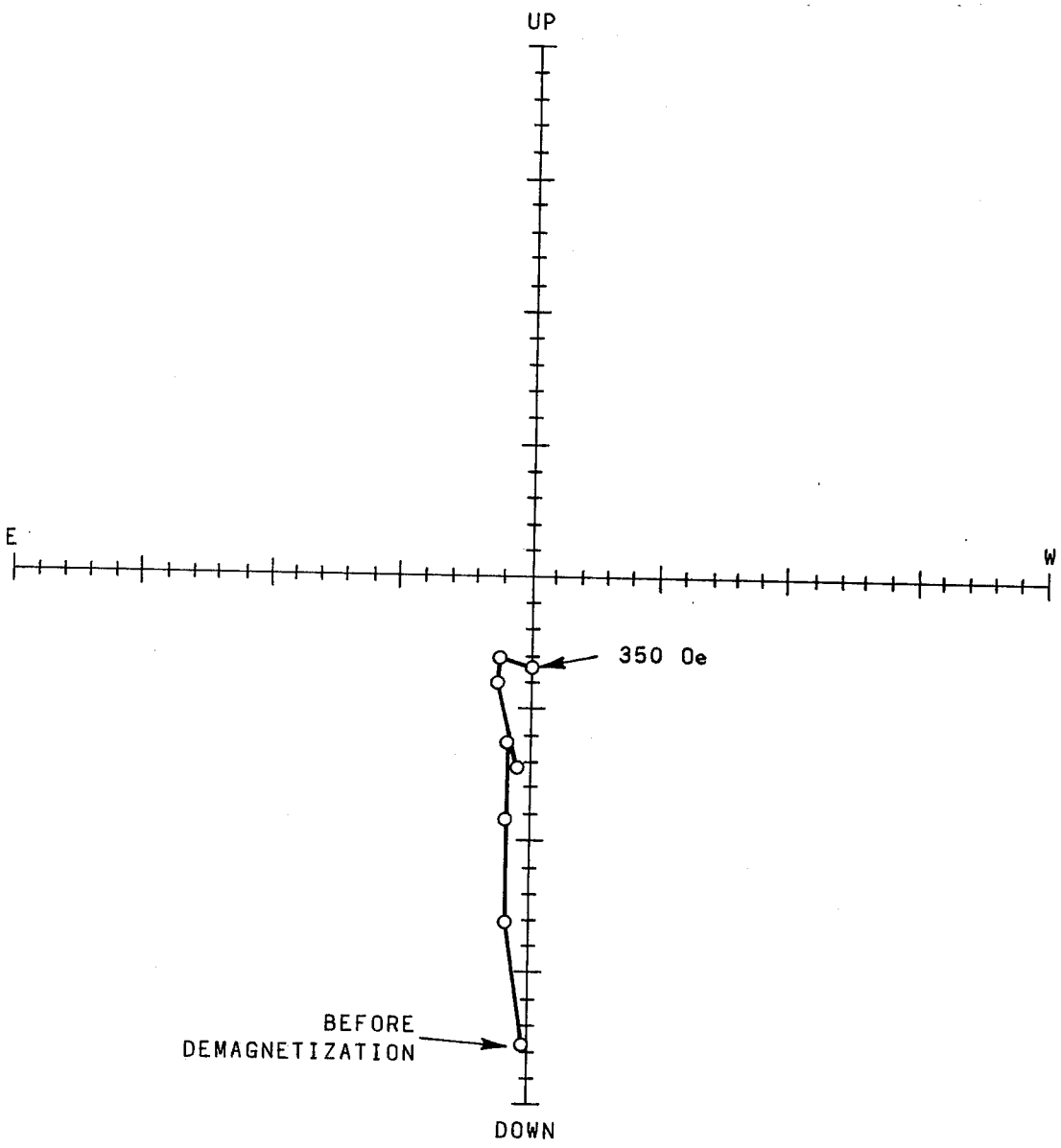

FIG. 6 presents a plot of "Z" versus "Y", for the date of Table VI, where "Y" increases positively in the East direction and "Z" increases positively in the down direction.

The borehole core samples used in Examples I–VI were taken from the Northern hemisphere. As has been previously stated the vertically inclined remanent magnetization component should point down towards the bottom of the core for cores taken in the Northern hemisphere. By pointing down it is meant that an arrow drawn from the point where the remanent magnetism has been totally removed (350 oersteds) to the point where a measurement was taken of the magnetization before the demagnetization procedure was started would point in the down direction.

Examples I–VI all illustrate the removal of a strong remanent magnetic component oriented vertically. For Examples I, II and VI the remanent magnetic component was oriented vertically downward towards the bottom of the borehole core indicating that the sample was correctly vertically oriented, i.e. the top and bottom had not been reversed. This orientation was found to agree with the marks made by the mechanical orientation tool on the borehole core. The borehole sample analyzed in Examples III–V were also thought to be correctly oriented. However, progressive partial demagnetization revealed a vertically oriented remanent magnetic component oriented vertically upward. This indicated that the section of core sampled had been mistakenly inverted, i.e. the top and bottom had been reversed. Subsequent close examination of the marks made on the core by the mechanical orientation tool proved this to be true.

While the invention has been described in terms of a presently preferred method for utilizing the artificial remanent magnetism imparted by the drill string of the drill rig to correctly orient borehole cores, reasonable variations and modifications of this method are possible by those skilled in the art, within the scope of the described invention and the appended claims.

That which is claimed is:

1. A method for longitudinally orienting a borehole core with respect to the longitudinal axis of the drill string which drilled said borehole core in such a manner that the original longitudinal attitude of said borehole core within the earth may be determined comprising the steps of:

partially demagnetizing at least a portion of said borehole core in steps to thereby at least partially remove in steps the artificial remanent magnetism imparted to said borehole core by said drill string, said artificial remanent magnetism being oriented substantially parallel to the longitudinal axis of said drill string;

measuring the direction and intensity of the total magnetism of said borehole core at desired intervals during the partial demagnetizing procedure;

establishing an artificial remanent magnetism vector which extends from the final measurement of the direction and intensity of the total magnetism of said borehole core taken during said partial demagnetizing procedure towards the initial measurement of the direction and intensity of the total magnetism of said borehole core taken during said partial demagnetizing procedure; and orienting said borehole core in such a manner that said artificial remanent magnetism vector points at least substantially downwardly towards the bottom of said borehole core for a borehole in the Northern hemisphere and points at least substantially upwardly towards the top of said borehole core for a borehole in the Southern hemisphere.

2. A method in accordance with claim 1 wherein the direction and intensity of said total magnetism is measured before said partial demagnetizing procedure is started and after each step in said partial demagnetizing procedure.

3. A method in accordance with claim 2 additionally comprising the step of plotting the direction and intensity of said total magnetism measured during said partial demagnetizing procedure to thereby provide a visual representation of said artificial remanent magnetism vector.

4. A method in accordance with claim 1 wherein the partial demagnetization steps comprise 50 oersted steps.

5. A method in accordance with claim 1 wherein the direction of the artificial remanent magnetism vector is determined by drawing an arrow from a point representative of a measurement of the total magnetism after the artificial remanent magnetism has been at least partially removed to the point representative of a measurement of the total magnetism before the demagnetization procedure is started, with the direction of the arrow being the direction of the artificial remanent magnetism vector.

* * * * *